United States Patent [19]

Prince

[11] 3,985,289

[45] Oct. 12, 1976

[54] TWO-PIECE CONTAINER

[75] Inventor: Kenneth E. Prince, Indianapolis, Ind.

[73] Assignee: Eli Lilly and Company, Indianapolis, Ind.

[22] Filed: Apr. 10, 1975

[21] Appl. No.: 566,880

[52] U.S. Cl. ..... 229/44 R; 229/45 R; 206/464

[51] Int. Cl.[2] ..... B65D 5/66; B65D 45/00

[58] Field of Search ..... 229/45, 44 R; 220/354, 220/306, 334; 206/464

[56] References Cited

UNITED STATES PATENTS 3,128,002 4/1964 Buchanan ..... 220/334

3,809,305 5/1974 Persson ..... 229/45

*Primary Examiner*—William Price
*Assistant Examiner*—Douglas B. Farrow
*Attorney, Agent, or Firm*—Houston L. Swenson; Everet F. Smith

[57] ABSTRACT

A container having a cover removably connected to a receptacle with the receptacle being formed from a flexible material such as paperboard whereas the cover may be formed from a thin flexible plastic sheet material.

1 Claim, 9 Drawing Figures

TWO-PIECE CONTAINER

BACKGROUND OF THE INVENTION

In the providing of containers for the merchandising of various types of products considerable effort has been expended to utilize plastic materials in conjunction with paperboard materials. In such a manner the primary advantages and features of each material may be combined to provide an unusually attractive and yet inexpensive package. As an example, paperboard material has been found to be not only light weight but can be readily printed with various instructions and decorative material. Plastic material, on the other hand, can provide rigidity equal to that or greater than paperboard material and yet produce the added feature of transparency. It is apparent that when a container is to be formed from two different materials it usually will be necessary to provide a means for coupling the cover to the receptacle. This gives rise to one of the more commonly experienced problems of how to construct appropriate mechanical elements in a plastic section of the container which will connect with cooperating elements in a paperboard material. Added to this problem is the frequent desirability of being able to provide a cover that is hinged to the receptacle and which can cooperate with the receptacle to maintain a closed position during transmittal of the package.

U.S. Pat. No. 3,809,305, Persson, illustrates one approach to the general problem outlined above. In the Persson structure a carton cover utilizes locking tongues which combine with recesses in a plastic receptacle for coupling thereto. This structure does not appear to be adaptable for the particular needs of many packagers who wish to provide a transparent cover that is formed from plastic material and can be hinged to the paperboard receptacle.

SUMMARY OF THE INVENTION

My invention deals with the above-mentioned problems by providing for a carton which may be formed from paperboard material and which has a rear wall comprising a pair of inner and outer flexible panels. The cover of my invention may be formed from a transparent flexible plastic sheet material such as polyvinyl chloride of approximately 25 mils. This cover has a rear wall with a flat tongue section extending therefrom and which extends between the pair of inner and outer walls. The tongue section is maintained in this position by an integrally formed projection which extends through a cutout in one of the panels of the rear wall of the receptacle.

DESCRIPTION OF THE PREFERRED EMBODIMENT

Figure 1:
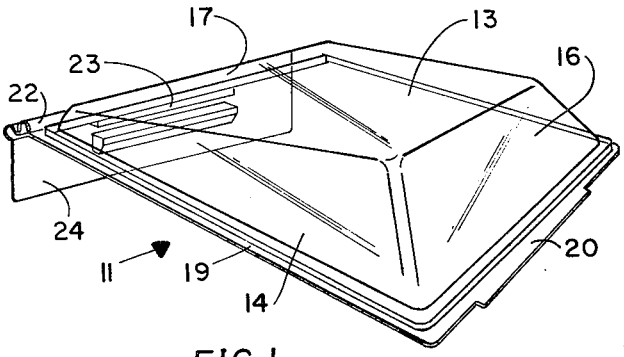
FIGS. 1 and 2 are perspective views of the cover and receptacle, respectively, of this invention with FIG. 3 being a perspective view of the resulting container.
Figure 9:
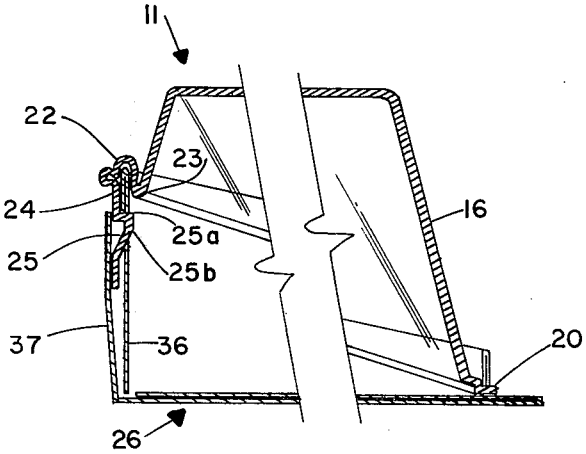
FIG. 9 is an enlarged view taken in cross section along line 9—9 of FIG. 8.

Referring to FIG. 1, a rectangular cover 11 which forms the second section of my container is illustrated as being formed from a transparent plastic material. This configuration is not controlling with respect to the overall features of my invention inasmuch as other types of containers including triangular and cirular ones can be adapted to embody the inventive concepts of my container. Cover 11 has a top wall 13, a pair of side walls 14, a front wall 16 and a rear wall 17. A flange 19 extends around the pair of side walls and front walls and primarily serves to provide added strength to the cover. A latch tab 20 extends from this flange at a central position on the front wall 16. Integrally formed with the bottom edge of rear wall 17 is a roll-type hinge 22 of the type taught in U.S. Pat. No. 3,551,940. Extending downwardly from the connection between hinge 22 and rear wall 17 is a double-walled stabilizing flange 23 (FIG. 9). A flat tongue 24 extends integrally from hinge 22 and has a projection 25. This projection is wedge-shaped with a shoulder 25a and a tapered surface 25b pointed toward the end of the tongue.

Figure 2:
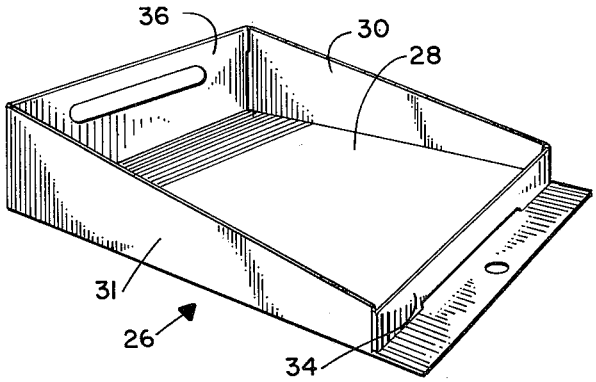
Figure 3:
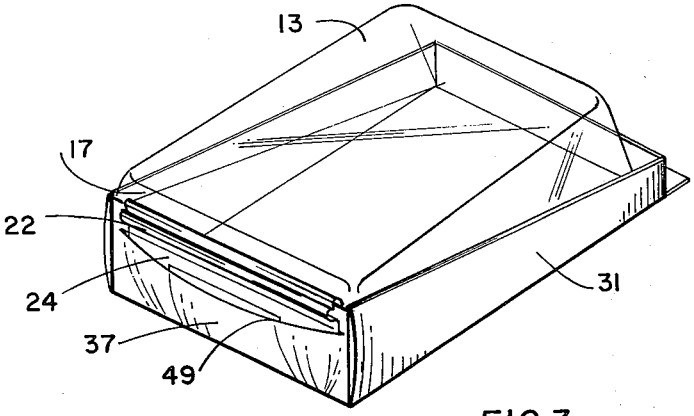
Figure 4:
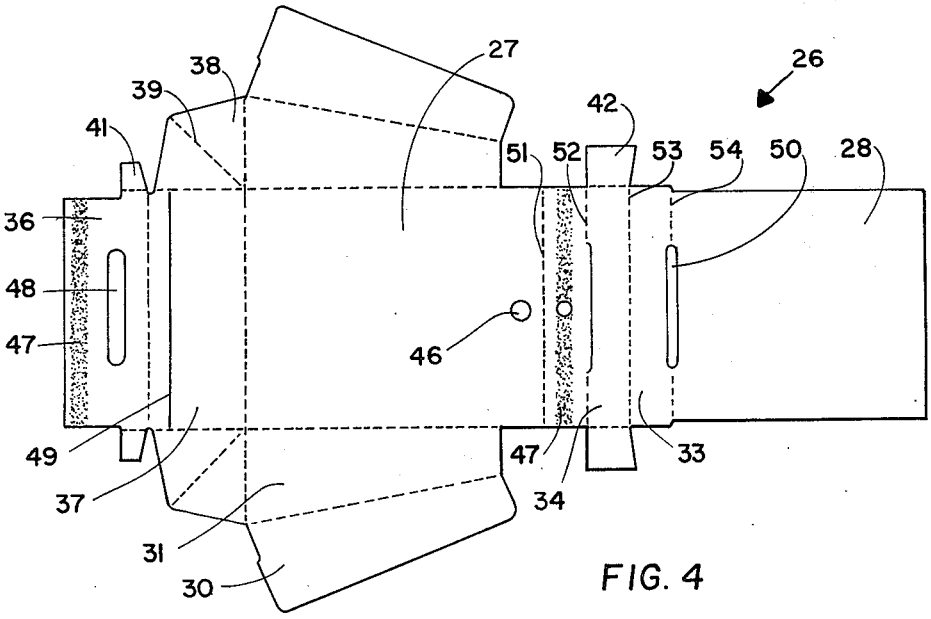
FIG. 4 is a blank paperboard pattern which is suitable for forming the receptacle of FIG. 2.
Figure 5:
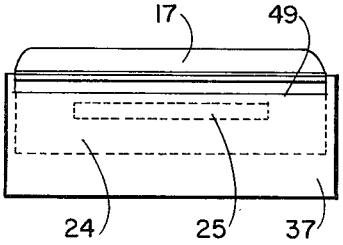
FIGS. 5, 6, 7 and 8 are plan views of the rear, side, front and top of the container of this invention.
Figure 6:
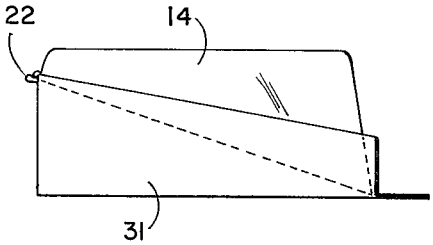
Figure 7:
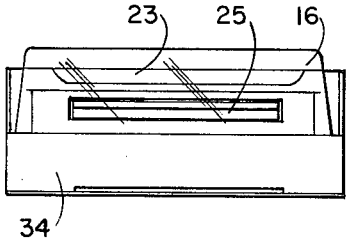
Figure 8:
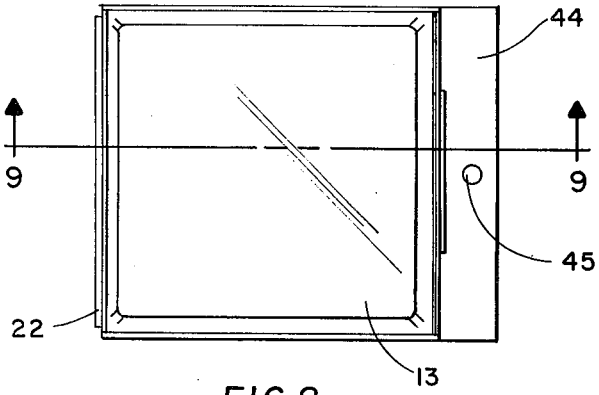

Referring to FIGS. 2 and 4, the receptacle or first section of my container may be formed from a paperboard material although other materials having similar properties may likewise be used. The particular design of this receptacle utilizes a conventional double wall and bottom structure. However, it is to be understood that my invention is not limited to this precise design inasmuch as my inventive concept is primarily dependent on a receptacle having merely a double wall at its rear. Thus, receptacle 26 has a bottom outer wall 27 and inner bottom wall 28, a pair of inner and outer side walls 30 and 31, respectively, inner and outer front walls 33 and 34, respectively, inner and outer rear walls 36 and 37, respectively, a pair of corner tuck flaps 38 having crease lines 39, two pairs of side tuck flaps 41 and 42, and a display hanger flap 44 having an aperture 45 which cooperates with a like aperture 46 in bottom wall 27. Glue strips 47 may be applied to panels 36 and 44.

Particular attention is directed to the elongated cutout 48 in the inner rear wall of panel 36. Outer rear wall 37 has a parallel cut line 49 extending across its entire width. At the junction of inner bottom wall 28 and inner front panel 33 an elongated cutout 50 is provided.

To form the receptacle as shown in FIG. 2, fold lines 51, 52, 53, and 54 may be creased thereby permitting hanger flap 44 to be doubled and glued onto bottom wall panel 27 with front wall panels 33 and 34 folded against each other in an upright position. This enables inner bottom wall panel 28 to be positioned on top of panel 27. Tuck flaps 38 may be creased inwardly along lines 39 thereby elevating the outer side wall panel 31 and outer rear wall panel 37. Inner rear wall panel 36 is then folded and glued against the upright outer rear wall panel 37 with side tuck flaps 41 being folded inwardly. Inner side wall panels 30 are then folded downwardly over tuck flaps 41 and against the outer side wall panel 31.

To assemble the cover to the receptacle, tongue 24 of the cover is inserted through cut line 49 between the pair of rear walls 36 and 37 of the receptacle. This can be readily accomplished by slightly flexing outwardly the lower portion of rear wall 37 which is separated from its upper portion by the cut line 49. Projection 25 on tongue 24 is forced downwardly between the inner and outer rear walls of the receptacle until its tapered portion 25b penetrates slot 48 and becomes engaged therein by means of its upper flat portion 25a. It is to be noted that once this projection is engaged in slot 48 and the cover is closed stabilizing flange 23 which extends from the receptacle's rear wall is in adjacent contact with the upper midsection portion of inner rear wall 37. Flange 23 also aids in locating the upper roll portion of hinge 22 over the edge of this rear wall and prevents binding of the hinge with the rear wall. Thus, cover 11 is securely connected to the receptacle 26 but has a 180° hinging action.

To close the container cover 11 is pushed downwardly against the receptacle whereby the latch 20 extends and locks into cutout 50. The container can be readily opened by simply flexing outwardly front wall 16 whereby the latch can be removed from cutout 50. As the cover is raised stabilizing flange 23 is raised away from the rear wall of the receptacle and the hinge rolls likewise become spaced from this rear wall. However, projection 25 is unaffected and stays engaged with cutout 48. Consequently, cover 11 does not fully separate from receptacle 26 when the container is opened and closed.

I claim:

1. A container comprising first and second sections, said first section having a rear wall formed from a pair of inner and outer integral flexible panels with the inner panel having a cutout and the outer panel having a cut parallel to its top edge juxtaposed to said cutout, said second container being removably connected to said first section by a flat tongue extending from a rear wall of said second section and positioned between said first section rear walls, said tongue having a transversely formed, wedge-shaped configuration snugly fitting in said cutout with the tapered portion of said wedge-shaped configuration pointed toward the end of said tongue, said tongue being integrally connected to said second section rear wall by a hinge element having a hollow portion closely straddling an upper edge of said first section rear wall and a stabilizing flange in adjacent contact with the interior of said first section rear wall when the container is closed.

* * * * *